US005989401A

United States Patent [19]

Breneiser et al.

[11] Patent Number: 5,989,401

[45] Date of Patent: Nov. 23, 1999

[54] EXPANDABLE VERTICAL DIP PRETREATMENT AND ELECTRO-DEPOSITION SYSTEM

[75] Inventors: Thomas R. Breneiser, Rochester Hills; Richard H. Ott, Brighton; Syed Salman, Troy, all of Mich.

[73] Assignee: Chrysler Corporation, Auburn Hills, Mich.

[21] Appl. No.: 09/108,987

[22] Filed: Jul. 1, 1998

[51] Int. Cl.[6] ..... C25D 13/12

[52] U.S. Cl. ..... 204/484; 204/512; 204/623

[58] Field of Search ..... 204/623, 512, 204/484

[56] References Cited

U.S. PATENT DOCUMENTS

| | | | |
|---|---|---|---|
| 839,719 | 12/1906 | Broderick . | |
| 2,048,937 | 7/1936 | Larson | 91/55 |
| 2,633,855 | 4/1953 | Ransohoff | 134/58 |
| 2,945,579 | 7/1960 | Barton | 198/19 |
| 2,965,110 | 12/1960 | Borodin | 134/76 |
| 2,989,050 | 6/1961 | Finston | 134/77 |
| 3,073,324 | 1/1963 | Finston | 134/77 |
| 4,402,765 | 9/1983 | Goto et al. | 148/6.15 R |
| 4,473,604 | 9/1984 | Rolle et al. | 427/444 |
| 4,917,042 | 4/1990 | Kuronaga et al. | 118/72 |
| 5,364,469 | 11/1994 | Wakabayashi | 118/423 |
| 5,433,783 | 7/1995 | Ichinose et al. | 118/416 |

*Primary Examiner*—Kishor Mayekar

*Attorney, Agent, or Firm*—Roland A. Fuller, III

[57] ABSTRACT

A vertical dip pretreatment and electro-deposition system has a plurality of dip stations and a plurality of spray stations. The process limited dip stations, such as the degrease dip station, the phosphate dip station and the electro-coat dip station, have expandable dip tanks which can have a bulkheads that divide the tanks into two sections providing the tanks with two compartments, or have removable end walls that can be removed and replaced with a tank section. If the bulkhead divided tanks are used, during the initial period of operation when production rates would typically be less than ten to twelve jobs an hour, one compartment of each expandable dip tank is used for immersion and the other compartment left dry or used for other purposes such as storage. When volume increases to above the design capacity, the expandable tanks are expanded. If bulkhead divided tanks are used, the bulkhead is removed which joins the first and second compartments, thus doubling the length of the tank. If the removable end wall tanks are used, the removable end walls are removed and replaced with tank sections to double the length of the tanks. In operation, the system is then set up so that after the product is lowered in the expanded tank, it stays in the first half of the expanded tank for half or less of the process time. The product is then kept in the lowered position in the expanded tank and moved to the second section of the expanded tank where it remains until the end of the required process time. The index time for the system is thus half or less of the total cycle time of the process. In this manner, production throughput of the system is increased.

10 Claims, 4 Drawing Sheets

EXPANDABLE VERTICAL DIP PRETREATMENT AND ELECTRO-DEPOSITION SYSTEM

BACKGROUND

This invention relates to pre-treatment and electro-priming systems for paint lines, and more particularly, to an expandable horizontal travel/vertical dip pretreatment and electrodeposition system.

In modem paint systems used to paint automotive bodies (or other metal parts) that are exposed to the elements or other corrosive environments, the automotive body is first treated by the application of protective coatings before the color coat is applied. The process involves passing the body through several spay or immersion chemical baths, followed by immersion into an electro-deposition bath where a coating is applied.

One commonly used treatment system involves the application of a zinc phosphate or similar corrosion protection coating system followed by the application of a primer. The body is immersed in a zinc phosphate bath and, after removal from the zinc phosphate bath, is rinsed with chemicals and water to prepare the body for the electro-priming operation. The body is then immersed in an electro-coating tank, such as a cathodic or anodic electro-deposition paint primer tank, where a paint primer coating is deposited on the surface of the body through an electrolysis process. Subsequent rinses remove any undeposited primer. The body is then cured to get a protective primer coating. Once the body is finished with this treatment, a second coat of surface primer is optionally applied followed by a color topcoat and/or clear coat utilizing a separate paint line.

One type of pretreatment and electro-deposition system conventionally used for lower volume production in the auto industry is the vertical dip/horizontal travel type of system that utilizes a combination of immersion and spray stations. The bodies to be treated are horizontally indexed to a sequential series of stations. Some stations are vertical dip stations in which the body is lowered into a tank containing a treatment bath, such as zinc phosphate or a paint primer. Other stations are spray stations where the body is sprayed with a treatment spray or a rinse. The bodies remain at the stations for a set period of time. The stations are typically sized to handle one body at a time and the cycle time for the system is determined by the process that requires the longest amount of time to complete. This is typically the electro-deposition process or processes that are carried out in a vertical dip tank or tanks and require the body be immersed and, in the case of the electro-deposition process, under charge for around two to three minutes.

Treatment systems for higher volume production above about twelve jobs an hour typically utilize an overhead drag through conveyor systems or additional vertical dip systems. In a system of the overhead drag through conveyor system type, rather than indexing the body between stations, the body is continuously moved through the stations and in the case of a station having an immersion tank, such as an electro-deposition station, the body is immersed in the tank and dragged through the tank. The tank is sized so that the time that it takes to drag the body through is sufficient for the particular process to be completed. For example, as discussed above, electro-deposition requires that the body be immersed in the coating tank and under charge for approximately three minutes. Therefore, the electro-deposition tanks are sized so that it will take approximately three minutes to drag the body through them after full immersion.

The horizontal drag through systems are significantly more expensive than the vertical dip systems so that the vertical dip system is typically the system used for lower volume production of around ten to twelve jobs an hour or less. Given the limiting factor that each electro-deposition step requires a cycle time of about five minutes to transfer, immerse and process, vertical dip systems are typically capacity constrained to about ten to twelve jobs per hour. Additional vertical dip systems are typically used to achieve production volumes of above ten to twelve jobs per hour.

It is an object of this invention to provide a vertical dip pretreatment and electro-deposition system wherein the throughput limiting immersion tanks can have two sections with a bulkhead therebetween that divide them into two compartments or have removable end walls. With tanks having bulkheads dividing them into two sections, the bulkhead is removed to expand the tanks so that the product can be indexed through the tank thus permitting more than one product to be immersed in the tank at a time. With tanks having removable end walls, the removable end walls are removed and replaced with tank sections thus extending the tank size so that the extended tank functions similarly to the two section tank with its bulkhead removed.

A vertical dip pretreatment and electro-deposition system in accordance with this invention has immersion or dip tanks that are expandable. When production rates are below or up to the design capacity of the system, the expandable tanks are used unexpanded. If the expandable tank is the two-section bulkheaded divided type, only one compartment of each electro-deposition tank is used for the electro-deposition process and the product being treated will be immersed in that compartment. The other compartment is left dry and can be used as a storage or dump tank, thus eliminating the need for a separate dump tank. In operation, the product being coated is lowered into the specific tank for the specific treatment for the requisite process time and then raised out and moved to the next station in the system. When volume increases to above the design capacity of the system, the tanks are expanded either by removing the bulkheads, in the case of the two section bulkhead divided tanks, or by removing the removable end walls and replacing them with tank sections. Separate storage or dump tanks are then provided where required. In operation, the expanded system is set up so that when a product reaches an immersion station, it is lowered into the first section of the tank where the process begins. The product is then indexed or moved in the lowered position into the second section of the tank while the process continues. Upon completion of the process, the product is raised out of the tank and indexed to the next process station. Once the product moves out of the first section of an immersion tank, a second product can be lowered into the first section of the immersion tank to start that station's process on the second product. This effectively increases the production throughput of the system. Alternatively, each tank requiring expansion is expanded or lengthened sufficiently to permit the product to be dragged through it for the time needed for the process to complete.

BRIEF DESCRIPTION OF THE DRAWINGS

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

DETAILED DESCRIPTION

Figure 1:
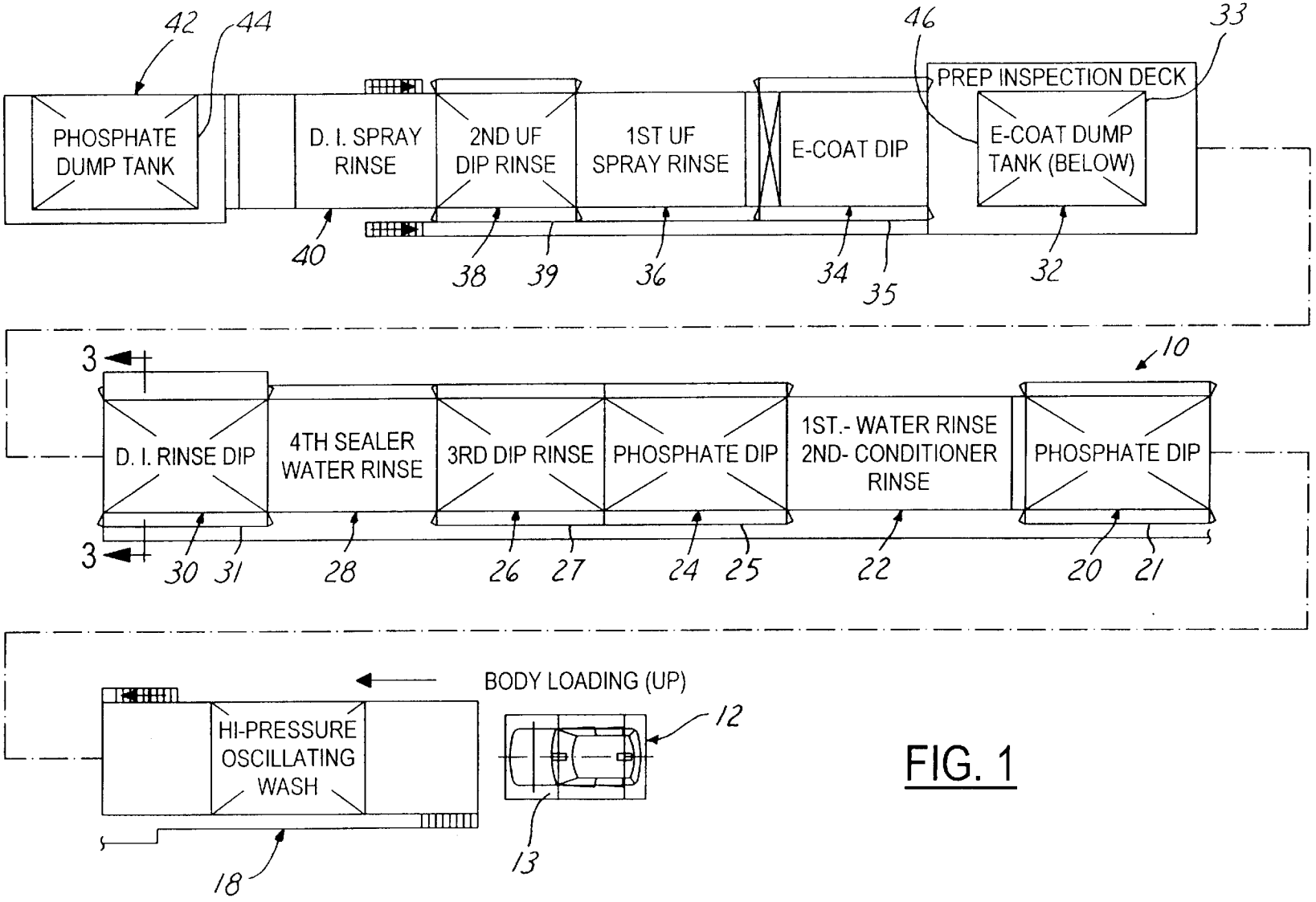
FIG. 1 is a top plan view of a prior-art vertical dip pretreatment and electro-deposition system.
Figure 2:
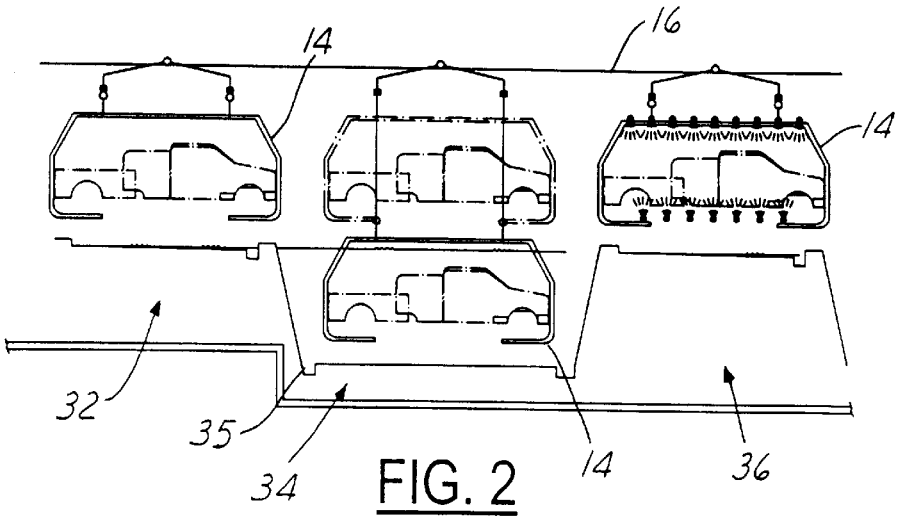
FIG. 2 is a side plan view of a portion the prior art vertical dip pretreatment and electro-deposition system of FIG. 1.
Figure 3:
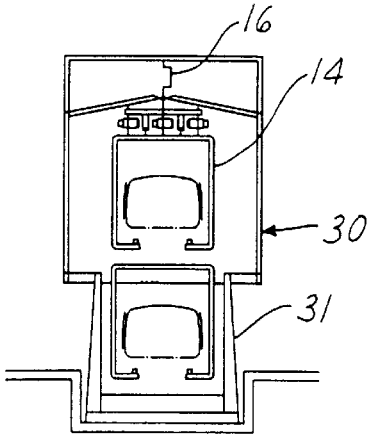
FIG. 3 is a plan view taken along the line 3—3 of the prior art vertical dip pretreatment and electro-deposition system of FIG. 1.

Referring to FIGS. 1–3, prior art vertical dip pretreatment and electro-deposition system 10 has a plurality of immersion or dip stations (immersion and dip are used synonymously herein) and spray stations whereat various cleaning and treatment operations are carried out. System 10 includes a body loading station 12, a high pressure oscillating spray wash station 18, a degrease dip station 20 having a dip tank 21, a water/conditioner rinse spray station 22, a phosphate dip station 24 having a dip tank 25, a rinse dip station 26 having a dip tank 27, a sealer/water rinse spray station 28, a de-ionized water rinse dip station 30 having a dip tank 31, a pre-inspection deck station 32, an electro-coat electro-deposition dip station 34 having a dip tank 35, an ultrafiltration (UF) rinse spray station 36, a UF dip station 38 having a dip tank 39, a deionized ionized water rinse spray station 40, and an unload station 42. System 10 also includes dump tank 44 for phosphate dip tank 25 and dump tank 46 for electro-coat dip tank 36 into which the contents of dip tanks 25, 35 are respectively emptied when it is necessary to empty them. Phosphate dump tank 44 is illustratively located beneath unload station 42 and electro-coat dump tank 46 is illustratively located beneath pre-inspection deck 32. System 10 is provided with conventional control systems, motors, pumps and the like which are not shown. The electro-deposition station (electro-coat dip station 34) is provided with conventional electro-charging systems (not shown) as known in the art.

The system 10 and the inventive vertical dip pretreatment and electro-deposition system 100 are described as treating an automobile body 13, but as is known, vertical dip pretreatment and electro-deposition systems can be used to treat a variety of different types of products. With reference to FIG. 1, the sequence of operations for system 10 progresses from right to left and starts at body load station 12 where an unpainted automobile body 13 is loaded onto a carrier 14 (FIGS. 2 & 3) carried by a horizontal conveyor 16. At the end of a set index time, the carrier 14 is moved by the conveyor 16 to the high pressure oscillating wash spray station 18 where it stops and remains for the set index time. During the index time, another automobile body 13 is loaded onto carrier 14.

The set index time is determined by the operation(s) in the system 10 that requires the longest time to complete, which in the case of a system used for electro-deposition are the electro-deposition operation (electro-coat dip station 34) degrease dip station 20 and phosphate dip station 24. As mentioned above, the electro-deposition operation requires that the product be immersed in the dip tank and under charge for about three minutes. The degrease dip operation and the phosphate dip station, while requiring somewhat less time to complete than the electro-deposition operation, still require more than one-half the time required for the electro-deposition operation.

At the expiration of the set index time, horizontal conveyor 16 indexes carriers 14 so that each carrier 14 is moved to the next station in sequence in system 10, and if the station is a dip station, lowered into the dip tank. For those stations that are immersion stations, such as degrease dip station 20, phosphate dip station 24, and electro-coat dip station 34, the automobile body 13 is lowered into the dip tank for that station and, in the case of electro-coat dip station 34, put under charge after being lowered into the tank.

Figure 4:
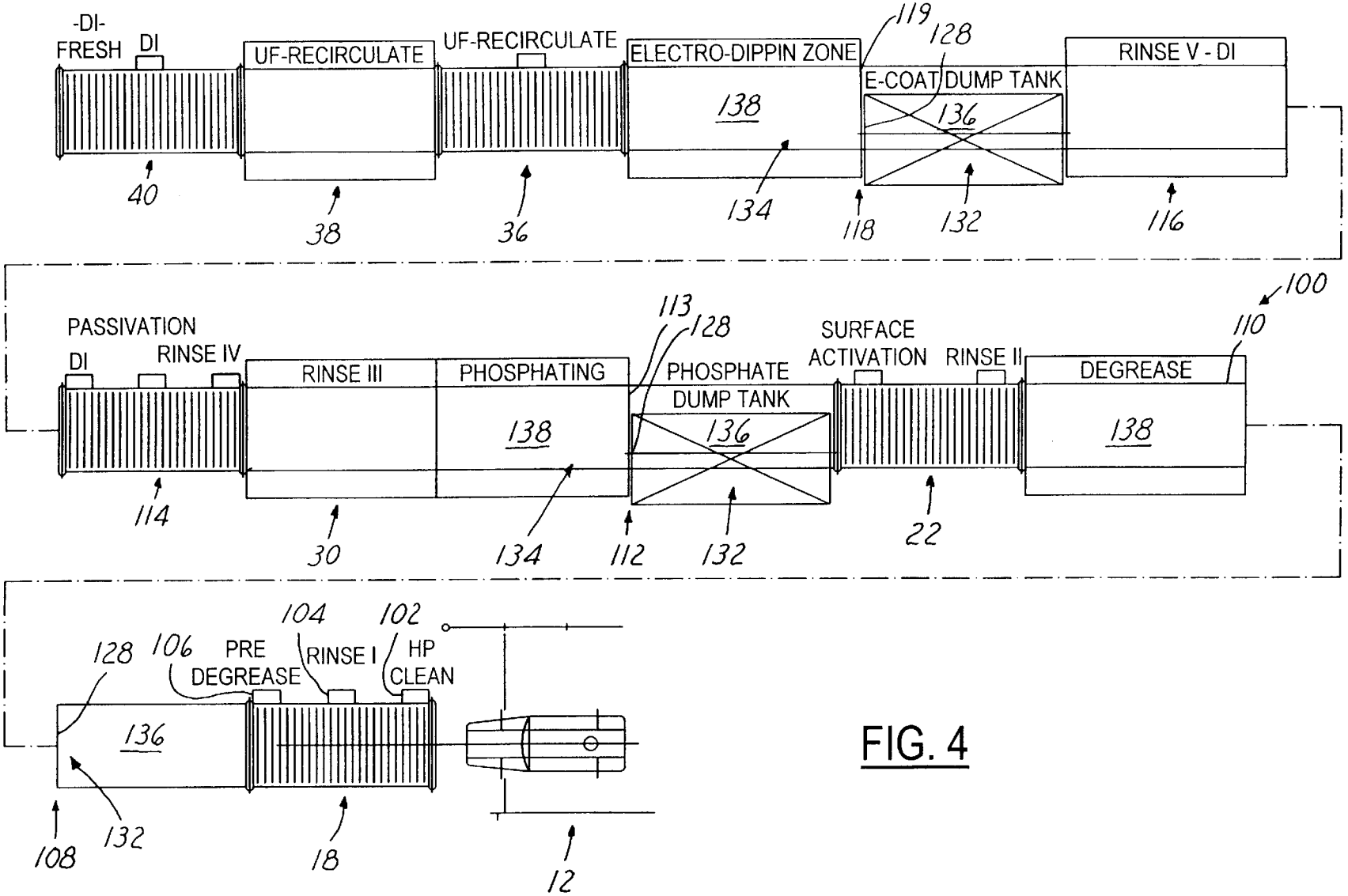
FIG. 4 is a top plan view of a vertical dip pretreatment and electro-deposition system in accordance with this invention.

Inventive vertical dip pretreatment and electro-deposition treatment system 100 is described with reference to FIGS. 4–6. System 100 includes body load station 12, high pressure oscillating wash spray station 18, degrease dip station 108, water/conditioner rinse spray station 22, phosphate dip station 112, rinse dip station 30, passivation rinse station 114, rinse dip station 116, electro-coat electro-deposition dip station 118, UF rinse spray station 36, UF dip station 38, de-ionized water rinse spray station 40 and an unload station (not shown) similar to unload station 42 (FIG. 1). High pressure oscillating wash spray station 18 preferably includes high pressure clean section 102, rinse section 104 and pre-degrease section 106. Degrease dip station 108 has an expandable dip tank 110, phosphate dip station 112 has an expandable dip tank 113, and electro-coat station 118 has an expandable dip tank 119, which are described in more detail below.

Figure 6:
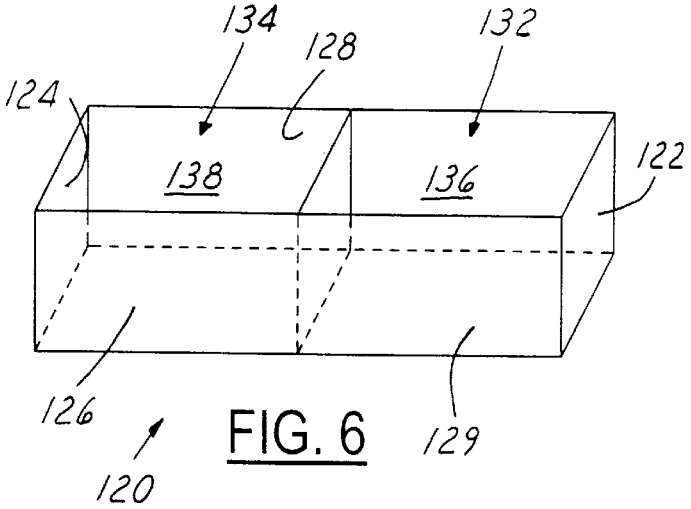
FIG. 6 is a side plan view of a two section bulkhead divided tank for use in a vertical dip pretreatment and electro-deposition system in accordance with this invention.

With reference to FIG. 6, an expandable dip tank 120, such as can be used for expandable dip tanks 110, 113 and 119, is described. Expandable dip tank 120 includes end walls 122, 124, side walls 126, 128, and bottom 129. Tank 120 comprises first and second sections 132, 134 with a bulkhead 130 therebetween extending between side walls 126, 128. Bulkhead 120 divides tank 120 into first and second separate compartments 136, 138. For convenience of reference, expandable dip tanks 110, 113 and 119 are each shown with first and second tank sections 132, 134 and first and second compartments 136, 138.

When 100 is being used for lower volume production of about ten to twelve jobs per hour or less, only one of first and second compartments 136, 138 of expandable dip tanks 110, 113 and 119 is used for the respective process, illustratively, second compartment 138. Horizontal conveyor 16 is set-up so that carrier 14 is not dropped into first compartment of tank but only into second compartment 138. In this configuration, first compartments 136 of expandable dip tanks 110, 113 and 119 are used as the dump tanks for their respective stations and may be provided with a plastic tunnel over them through which carriers 14 pass.

Figure 5:
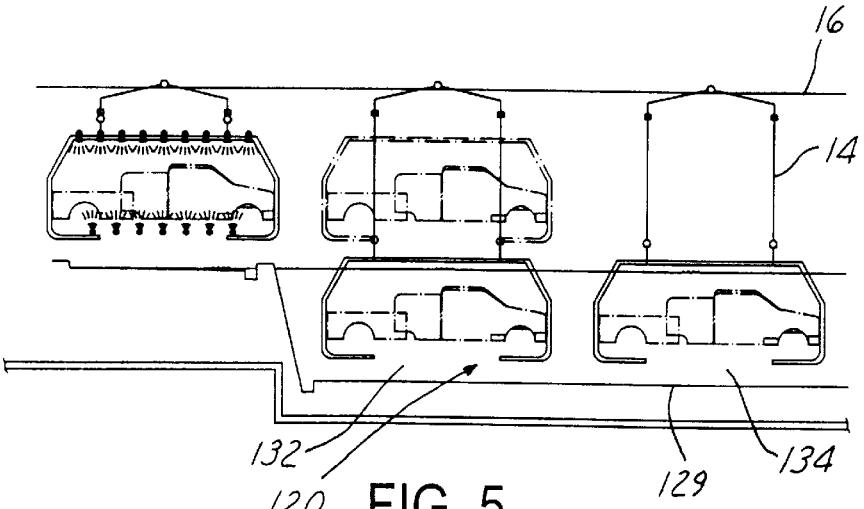
FIG. 5 is a side plan view of a portion of a vertical dip pretreatment and electro-deposition system in accordance with this invention.

When it is desirable to increase the production rate of system 100, the bulkhead 130 is removed from each expandable dip tank 110, 113 and 119, approximately doubling the length of each dip tank 110, 113 and 119 used for the respective immersion processes, as shown in FIG. 5. Separate dump tanks (not shown) are added for each of dip tanks 110, 113 and 119. System 100 is configured so that at each index, each of the carriers 14 that are in the second tank sections 134 of dip tanks 110, 113 and 119 are lifted out of the second tank sections 134, the carriers 14 that are in the first tank sections 132 are moved into the second tank sections 134, and respective carriers 14 that were just indexed to dip tanks 110, 113 and 119 are lowered into the first tank sections 132 of each dip tank 110, 113 and 119. Thus, the set index time can be decreased one-half, doubling the throughput of system 100, and each automobile body 13 remains in each dip tank 110, 113 and 119 the necessary process time as it spends approximately one-half of the process time in the first tank section 132 of each dip tank 110, 113 and 119, and the other half of the process time in the second tank section 134 of each dip tank 110, 113 and 119. While tank 120 is shown as having two sections 132, 134 separated by bulkhead 130, tank 120 can be constructed with three or more sections, with adjacent sections being separated by a bulkhead 130. Tank 120 can then be expanded or lengthened in increments by removing individual bulkheads 130 as appropriate.

Figure 7:
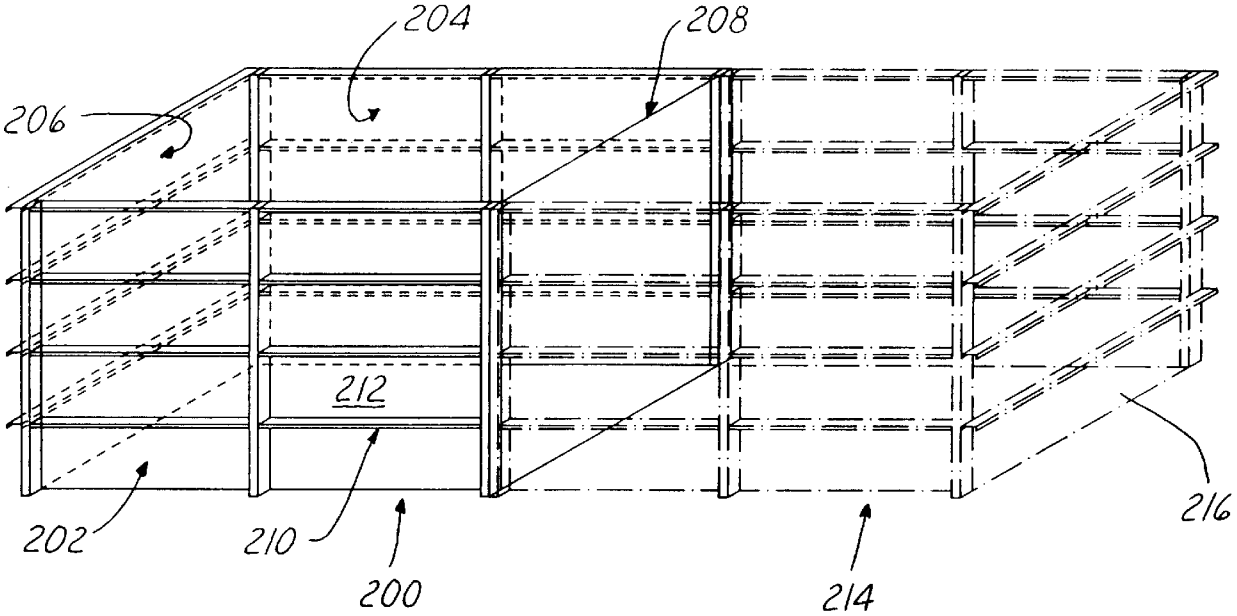
FIG. 7 is a side perspective view of flanged end tank, with an additional flanged tank section shown in phantom; for use in a vertical dip pretreatment and electro-deposition system in accordance with this invention.
Figure 8:
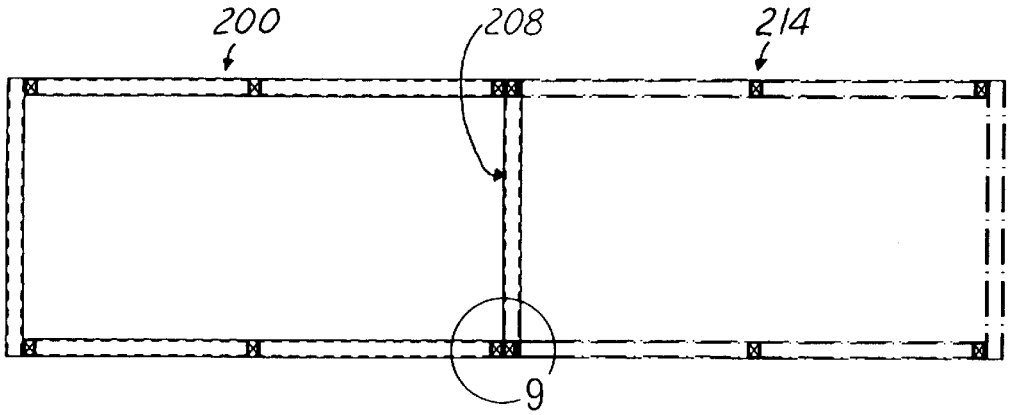
FIG. 8 is a top plan view of the tank of FIG. 7.

Referring to FIGS. 7 and 8, another embodiment of an expandable dip tank 200 according to this invention is shown. Tank 200 has side walls 202, 204, a first end wall 206 and a second removable end wall 208. Tank 200 is preferably constructed with support girts 210, sized for maximum tank size (after expansion). Second removable end wall 208 is secured in conventional fashion to side walls 202, 204 and a bottom 212 of tank 200.

When tank 200 is to be expanded, second removable end wall 208 is removed from tank 200 and replaced with a tank section 214, shown in phantom in FIG. 7. Tank section 214 is essentially a mirror image of tank 200 with second removable end wall 208 removed and when added to tank 200, effectively doubles the length of tank 200. Tank section 214 can also be provided with a removable end wall at end 216 to allow for further expansion, and first end wall 206 of tank 200 could also be removable to allow for further expansion.

Although the invention has been described in detail with reference to certain preferred embodiments and specific examples, variations and modifications exist within the scope and spirit of the invention as defined in the following claims.

What is claimed is:

1. A vertical dip pretreatment and electro-deposition system, comprising:

a. a plurality of stations including at least one immersion station having an expandable immersion tank;

b. a conveyor for conveying carriers from station to station and raising and lower the carriers at least into immersion tanks at those stations having immersion tanks; and c. each expandable immersion tank including opposed end walls, opposed sidewalls, and a bulkhead extending laterally across the tank from one sidewall to the other sidewall generally half-way between the opposed end walls and dividing first and second halves of the tank into two compartments wherein removing the bulkhead expands the expandable dip tank by joining the two compartments.

2. The system of claim 1 wherein the system includes a phosphate immersion station and an electro-coat immersion station each having an immersion tank that comprises said expandable immersion tank.

3. The system of claim 1 wherein the conveyor is configurable to lower a carrier into only one of the two compartments of a said expandable immersion tank and raise it from that compartment after the expiration of a set index when that expandable immersion tank has not been expanded by the removal of the bulkhead and lower a first carrier into the first half of said expandable immersion tank, to move a second carrier that has been lowered into the first half of said expandable immersion tank to the second-half of that expandable immersion tank when that expandable immersion tank has been expanded by the removal of the bulkhead and to also raise a third carrier in the second-half of the expandable immersion tank at the expiration of the set index.

4. In a vertical dip pretreatment and electro-deposition system having a plurality of spray stations and a plurality of dip stations, each dip station having a dip tank, at least one dip station comprising a process limiting dip station that requires a product being treated to remain in the dip tank for that station for a process limiting time, a conveyor for conveying carriers from station to station and lowering the carriers at least into the dip tanks, a method of expanding the system to increase the volume throughput of the system, comprising the steps of:

a. providing each process limiting dip station with an expandable dip tank having first and second sections with a bulkhead therebetween that divides the expandable dip tank into a first and second compartments;

b. removing the bulkhead of each expandable dip tank when it is desired to increase the volume throughput; and c. at the expiration of a set index, lowering a first carrier into the first section of each expandable dip tank, moving a second carrier in the first section of each expandable dip tank into the second section of each expandable dip tank, and raising a third carrier in the second section of the expandable dip tank out of the section and moving it to a next station in the system.

5. A vertical dip pretreatment and electro-deposition system comprising:

a. a plurality of dip stations and a plurality of spray stations, each dip station having a dip tank;

b. a conveyor for conveying carriers holding product to be treated by the system from station to station, the conveyor moving each carrier from a station to a next station at the end of a set index period, lowering each carrier into the dip tank of a dip station when that carrier is conveyed to a dip station and raising it from that dip tank at the end of the set index period before moving it to the next station;

c. the plurality of dip stations including a degrease dip station, a phosphate dip station and an electro-coat electro-deposition dip station, the degrease, phosphate and electro-coat dip stations each having an expandable dip tank;

d. each expandable dip tank having first and second sections with a bulkhead therebetween dividing it into first and second compartments; and e. the conveyor configured to lower and raise a carrier into only one of the first and second compartments of each expandable dip tank when that expandable dip tank is unexpanded and configured to lower a carrier into the first section and move it to the second section of each expandable dip tank at the expiration of the set index period when that expandable dip tank has been expanded by the removal of the bulkhead.

6. In a vertical dip pretreatment and electro-deposition system having a plurality of spray stations, a plurality of dip stations having dip tanks, and a conveyor for moving carriers holding products to be treated between stations and lowering the carriers into the tanks of the various stations, the plurality of dip stations including at least one electro-deposition station, a method of expanding the system to increase the volume throughput of the system, comprising the steps of:

a. providing an expandable dip tank for the dip tank of each electro-deposition station, each expandable dip tank having first and second sections with a bulkhead therebetween that divides the expandable dip tank into a first and second compartments;

b. removing the bulkhead of each expandable dip tank when it is desired to increase the volume throughput of the system; and c. at the expiration of a set index, lowering a first carrier into the first section of each expandable dip tank, moving a second carrier in the first section of each expandable dip tank into the second section of each expandable dip tank, and raising a third carrier in the second section of the expandable dip tank out of the second section and moves it to a next station in the system.

7. A vertical dip pretreatment and electro-deposition system, comprising:

a. a plurality of stations including at least one immersion station having an expandable immersion tank;

b. a conveyor for conveying carriers from station to station and raising and lower the carriers at least into immersion tanks at those stations having immersion tanks; and c. each expandable immersion tank including opposed end walls, opposed sidewalls, and a plurality of bulkheads extending laterally across the tank from one sidewall to the other sidewall generally half-way between the opposed end walls and dividing the tank into multiple compartments wherein removing each bulkhead expands the expandable dip tank by joining adjacent compartments.

8. A vertical dip pretreatment and electro-deposition system, comprising:

a. a plurality of stations including at least one immersion station having an expandable immersion tank;

b. a conveyor for conveying carriers from station to station and raising and lower the carriers at least into immersion tanks at those stations having immersion tanks; and c. each expandable immersion tank including opposed end walls, and opposed sidewalls, at least one of the end walls removably fastened to adjacent sidewalls where said removable end wall can be removed and replaced with a tank section to expand the expandable immersion tank.

9. The system of claim 8 wherein the conveyor is configurable to lower a carrier into the expandable immersion tank and raise it from that tank after the expiration of a set index when the tank has not been expanded and, when the expandable immersion tank has been expanded to an expanded immersion tank, to lower the carrier into a first portion of the expanded immersion tank, move it to a second portion of the expanded immersion tank, and raise it from the second portion of the expanded immersion tank at the expiration of the set index.

10. In a vertical dip pretreatment and electro-deposition system having a plurality of spray stations and a plurality of dip stations, each dip station having a dip tank, at least one dip station comprising a process limiting dip station that requires a product being treated to remain in the dip tank for that station for a process limiting time, a conveyor for conveying carriers from station to station and lowering the carriers at least into the dip tanks, a method of expanding the system to increase the volume throughput of the system, comprising the steps of:

a. providing each process limiting dip station with an expandable dip tank having at least first and second sections;

b. expanding each expandable dip tank when it is desired to increase the volume throughput; and c. at the expiration of a set index, lowering a first carrier into the first section of each expandable dip tank, moving a second carrier in the first section of each expandable dip tank into the second section of each expandable dip tank, and raising a third carrier in the second section of the expandable dip tank out of the section and moving it to a next station in the system.

* * * * *